US009347393B2

(12) United States Patent
Kusakabe et al.

(10) Patent No.: US 9,347,393 B2
(45) Date of Patent: May 24, 2016

(54) FUEL INJECTION DEVICE

(75) Inventors: Ryo Kusakabe, Hitachinaka (JP); Motoyuki Abe, Mito (JP); Yoshihito Yasukawa, Hitachinaka (JP); Noriyuki Maekawa, Kashiwa (JP); Takuya Mayuzumi, Hitachinaka (JP); Tohru Ishikawa, Kitaibaraki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 894 days.

(21) Appl. No.: 13/526,734

(22) Filed: Jun. 19, 2012

(65) Prior Publication Data

US 2012/0318883 A1 Dec. 20, 2012

(30) Foreign Application Priority Data

Jun. 20, 2011 (JP) ..... 2011-135875

(51) Int. Cl.

| | |
|---|---|
| ***H01H 9/00*** | (2006.01) |
| ***F02D 41/20*** | (2006.01) |
| ***F02M 45/12*** | (2006.01) |
| *F02M 63/00* | (2006.01) |
| *F02M 59/36* | (2006.01) |
| *F02M 51/06* | (2006.01) |
| *F02M 61/18* | (2006.01) |

(52) U.S. Cl.

CPC ..... *F02D 41/20* (2013.01); *F02M 45/12* (2013.01); *F02D 2041/2013* (2013.01); *F02D 2041/2055* (2013.01); *F02D 2041/2058* (2013.01); *F02D 2200/0618* (2013.01); *F02M 51/0671* (2013.01); *F02M 51/0685* (2013.01); *F02M 59/366* (2013.01); *F02M 61/1833* (2013.01); *F02M 63/0033* (2013.01)

(58) Field of Classification Search

USPC ..... 361/139, 144, 160

See application file for complete search history.

(56) References Cited

U.S. PATENT DOCUMENTS

| | | | | |
|---|---|---|---|---|
| 5,678,521 | A | 10/1997 | Thompson et al. | |
| 6,457,457 | B1 | 10/2002 | Harcombe | |
| 2003/0062029 | A1 | 4/2003 | Oyama et al. | |
| 2008/0276907 | A1 * | 11/2008 | Abe | F02D 41/20 123/472 |

(Continued)

FOREIGN PATENT DOCUMENTS

| | | | |
|---|---|---|---|
| EP | 0 681 100 | A2 | 11/1995 |
| EP | 1 298 305 | A2 | 4/2003 |

(Continued)

OTHER PUBLICATIONS

European Search Report dated Sep. 17, 2014 (seven pages).

(Continued)

*Primary Examiner* — Danny Nguyen

(74) *Attorney, Agent, or Firm* — Crowell & Moring LLP

(57) ABSTRACT

A method of controlling a fuel injection device that can control a small amount of injection is provided. A fuel injection device for use in an internal combustion engine, includes: a valve body that can open and close a fuel passage, a needle that transfers a force with the valve body, and executes valve opening/closing operation, and an electromagnet that includes a coil and a magnetic core provided as a driver for driving the needle, and a cylindrical nozzle holder disposed on an outer periphery of the magnetic core and the needle, in which a current is supplied to the coil to exert a magnetic attractive force between the magnetic core and the needle to open the valve body.

7 Claims, 7 Drawing Sheets

(56) References Cited

U.S. PATENT DOCUMENTS

| | | | | |
|---|---|---|---|---|
| 2008/0296414 | A1* | 12/2008 | Kubota | F02M 51/0675 239/533.11 |
| 2012/0234299 | A1 | 9/2012 | Abe et al. | |

FOREIGN PATENT DOCUMENTS

| | | | |
|---|---|---|---|
| JP | 11-93799 | A | 4/1999 |
| JP | 2000-27725 | A | 1/2000 |
| JP | 2001-221121 | A | 8/2001 |
| JP | 2002-70682 | A | 3/2002 |
| JP | 2002-317725 | A | 10/2002 |
| JP | 2003-106200 | A | 4/2003 |
| WO | WO 2011/065072 | A1 | 6/2011 |

OTHER PUBLICATIONS

Japanese Office Action dated Nov. 11, 2014 with English translation (six pages).
Japanese Office Action dated May 12, 2015 with English translation (Six (6) pages).

* cited by examiner

EMBODIMENT 2

DRIVER CIRCUIT CONFIGURATION FOR DETECTING VALVE OPENING TIMING

FUEL INJECTION DEVICE

BACKGROUND OF THE INVENTION

1. Field of the Invention

The present invention relates to a fuel injection device used for an internal combustion engine, a driving method and a driver circuit for the fuel injection.

2. Background Art

In recent years, from the viewpoints of the tougher control of carbon dioxide emission and concerns about exhaustion of fossil fuels, lower fuel consumption for an internal combustion engine has been demanded. For that reason, an effort to decrease the fuel consumption has been exerted by a reduction of various losses in the internal combustion engine. In general, when the losses are reduced, an output necessary for driving the engine is lowered with the result that the lowest output of the internal combustion engine is also lowered.

In the above internal combustion engine, there is a need to control the amount of fuel to be small enough for the lowest output for feeding the fuel. In recent years, as a technique for decreasing the fuel consumption of the internal combustion engine, there is a downsized engine that is downsized with a reduction in the displacement, and the output is obtained by a supercharger. In the downsized engine, because a reduction in the displacement enables a pumping loss and a friction to be reduced, the fuel consumption can be decreased. On the other hand, the supercharger is used to obtain a sufficient output, and a reduction in compression ratio associated with supercharging is suppressed by suction cooling effect of direct injection to realize the low fuel consumption. In particular, in the fuel injection device used for the downsized engine, there is a need to inject fuel over a wide range from the smallest amount of injection corresponding to the lowest output obtained by reducing the displacement to the largest amount of injection corresponding to the highest output obtained by supercharging. Accordingly, in order to decrease the fuel consumption, there is a need to reduce the smallest amount of injection that can be controlled by the fuel injection device. For the purpose of injecting a small amount of fuel, there is a method of controlling the amount of lift of the valve to a position lower than a full open position. For example, Japanese Patent Unexamined Application Publication No. 2000-27725 discloses a method for a fuel injection device in which the amount of leakage of a high-pressure fuel from a pressure control chamber is determined according to the amount of lift of an on-off valve disposed upstream of a needle valve, and the lift of the needle valve, that is, a fuel injection rate is controlled according to a pressure drop in the pressure control chamber to inject the small amount of fuel.

Also, Japanese Patent Unexamined Application Publication No. 2002-70682 discloses a method for a fuel injection device in which a pressure within the pressure control chamber is controlled by a pressure control value, the pressure control chamber is tightly sealed with the pressure control chamber, and the needle valve is stopped at an arbitrary lift position between a full open position and a full close position by the tightly sealed pressure control chamber.

SUMMARY OF THE INVENTION

In general, the amount of injection in the fuel injection device that allows a valve to be directly operated by an electromagnetic force is controlled by changing a time during which the valve is opened according to a pulse width of a driving pulse output from an ECU (engine control unit). As the pulse is longer, the amount of injection becomes larger, and the pulse is shorter, the amount of injection becomes smaller, and a relationship therebetween is substantially linear. However, in an area where the driving pulse is short, a valve body does not arrive at a maximum lift position, and the valve body moves at a so-called "intermediate position" between a valve closed position and the full open position, and the behavior of the valve body is unstable. The amount of lift of the valve body at the intermediate lift position is liable to be affected by a fluctuation in the fuel pressure. Under that condition, a variation in a flow rate of fuel injection for each shot, and a variation in the individual difference are large. This causes a possibility that an accident fire is induced. Coping with the above problem is disclosed in none of Japanese Patent Unexamined Application Publication Nos. 2000-27725 and 2002-70682.

The methods disclosed in Japanese Patent Unexamined Application Publication Nos. 2000-27725 and 2002-70682 pertain to a technique suitable for an injection valve in which the valve is hydraulically driven within the fuel injection device, and are mainly used in diesel engines. In order that those methods are used for inexpensive electromagnetic values, a pressure sensor is required to control the amount of lift of the valve body, resulting in such a problem that it is difficult to use those methods for gasoline internal combustion engines from the viewpoint of the costs. Also, the provision of the needle valve requires the pressure control chamber for controlling the needle valve, a regulating valve for adjusting a pressure within the pressure control chamber, and a driver for driving the regulating valve, resulting in such a problem that the configuration of the fuel injection device becomes complicated and large.

According to the present invention, valve closing operation starts at the intermediate position between the valve closed position and the maximum lift position of the valve body. A hydrodynamic force exerted on the valve body in a direction of closing the valve increases up to a lift position where the valve closing operation starts.

According to the present invention, the fuel injection device that is low in the costs and reduces the controllable amount of injection is driven.

DETAILED DESCRIPTION OF THE EMBODIMENTS

Figure 1:
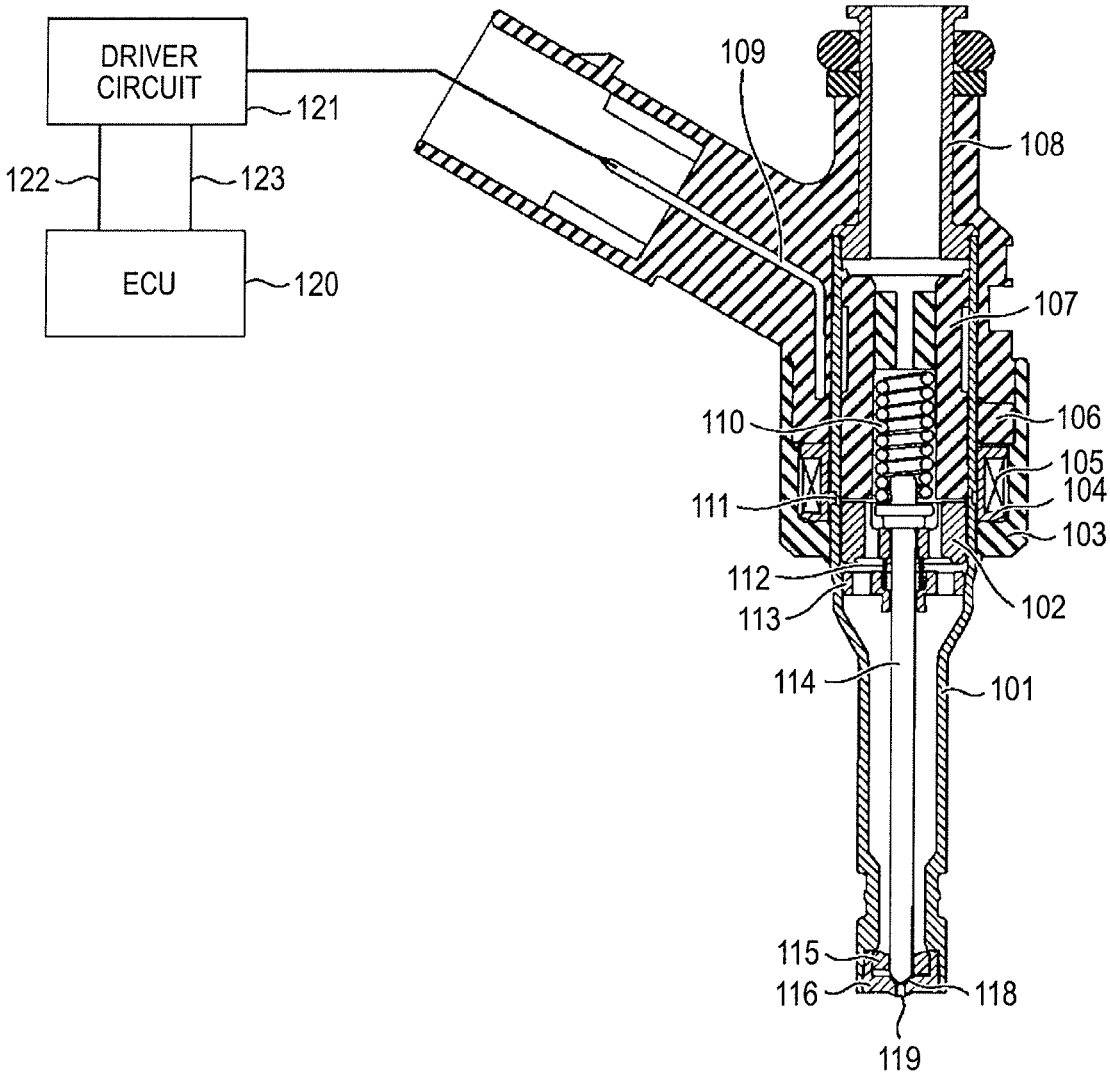
FIG. 1 is a vertical cross-sectional view illustrating a fuel injection device according to an embodiment of the present invention.

First, a description will be given of configurations and basic operation of a fuel injection device and a driving device thereof with reference to FIG. 1. FIG. 1 is a vertical cross-sectional view of the fuel injection device, and a diagram illustrating an example of the configurations of an EDU (driver circuit: engine drive unit) 121 for driving the fuel injection device, and an ECU (engine control unit) 120. In this embodiment, the ECU 120 and the EDU 121 are configured by different components. However, the ECU 120 and the EDU 121 may be configured by an integral component.

The ECU 120 retrieves signals indicative of a state of an engine from a variety of sensors, and computes a width of an appropriate injection pulse and an injection timing according to an operating condition of an internal combustion engine. The injection pulse output from the ECU 120 is input to the EDU 121 of the fuel injection device through a signal line 123. The EDU 121 controls a voltage to be applied to a solenoid (coil) 105, and supplies a current. The ECU 120 communicates with the EDU 121 through a communication line 122, and can switch a drive current generated by the EDU 121 to another according to a pressure of the fuel to be fed to the fuel injection device, and the operating condition. The EDU 121 can change a control constant by a communication with the ECU 120, and a current waveform is changed according to the control constant.

The configuration and operation of the fuel injection device will be described with reference to the vertical cross-section of the fuel injection device. The fuel injection device illustrated in FIG. 1 represents a normally closed electromagnetic valve (electromagnetic fuel injection valve). In a state where the electromagnetic valve is not energized by the solenoid 105, a valve body 114 is urged by a spring 110, and brought into a close contact with a valve seat 118 so as to be closed. In the closed state, a needle 102 is brought into close contact with the valve body 114 by a zero spring 112, and a gap is defined between the needle 102 and a magnetic core 107 in a state where the valve body 114 is closed. A fuel is fed from a top of the fuel injection device, and the fuel is sealed with the valve seat 118. When the valve is closed, a force by the spring 110 and a force by the fuel pressure are exerted on the valve body, and the valve body is pushed in the closing direction.

A magnetic circuit that generates an electromagnetic force for an on-off valve includes a nozzle holder 101 that is a cylindrical member arranged on an outer periphery of the magnetic core 107 and the needle 102, the magnetic core 107, the needle 102, and a housing 103. When a current is supplied to the solenoid 105, a magnetic flux occurs in the magnetic circuit, and a magnetic attractive force is generated between the needle 102 that is a movable member and the magnetic core 107. If the magnetic attractive force exerted on the needle 102 exceeds a sum of a load of the spring 110 and a force exerted on the valve body by a fuel pressure, the needle 102 moves upward. In this situation, the valve body 114 moves upward together with the needle 102, and moves until an upper end surface of the needle 102 collides with a lower surface of the magnetic core 107. As a result, the valve body 114 is spaced away from the valve seat 118, and the fed fuel is injected from a plurality of nozzles 119. The number of nozzles 119 may be single. Then, after the upper end surface of the needle 102 has collided with the lower surface of the magnetic core 107, the valve body 114 is left from the needle, and overshot. However, the valve body 114 comes to rest on the needle 102 after a given time. When the supply of current to the solenoid 105 stops, the magnetic flux occurred in the magnetic circuit is decreased, and the magnetic attractive force is reduced. If the magnetic attractive force becomes smaller than the force combining the load of the spring 110 with the hydrodynamic force exerted on the valve body 114 and the needle 102 by the fuel pressure, the needle 102 and the valve body 114 move downward. When the valve body 114 collides with the valve seat 118, the needle 102 is left from the valve body 114. On the other hand, the valve body 114 comes to rest after having collides with the valve seat 118, and the injection of fuel stops. The needle 102 and the valve body 114 may be integrally molded as the same member, or may be configured by different members, and combined together by a welding or press fitting method. If the needle 102 and the valve body 114 are formed of the same member, even if the zero spring 112 is not structurally provided, the advantages of the present invention are not changed.

Figure 2:
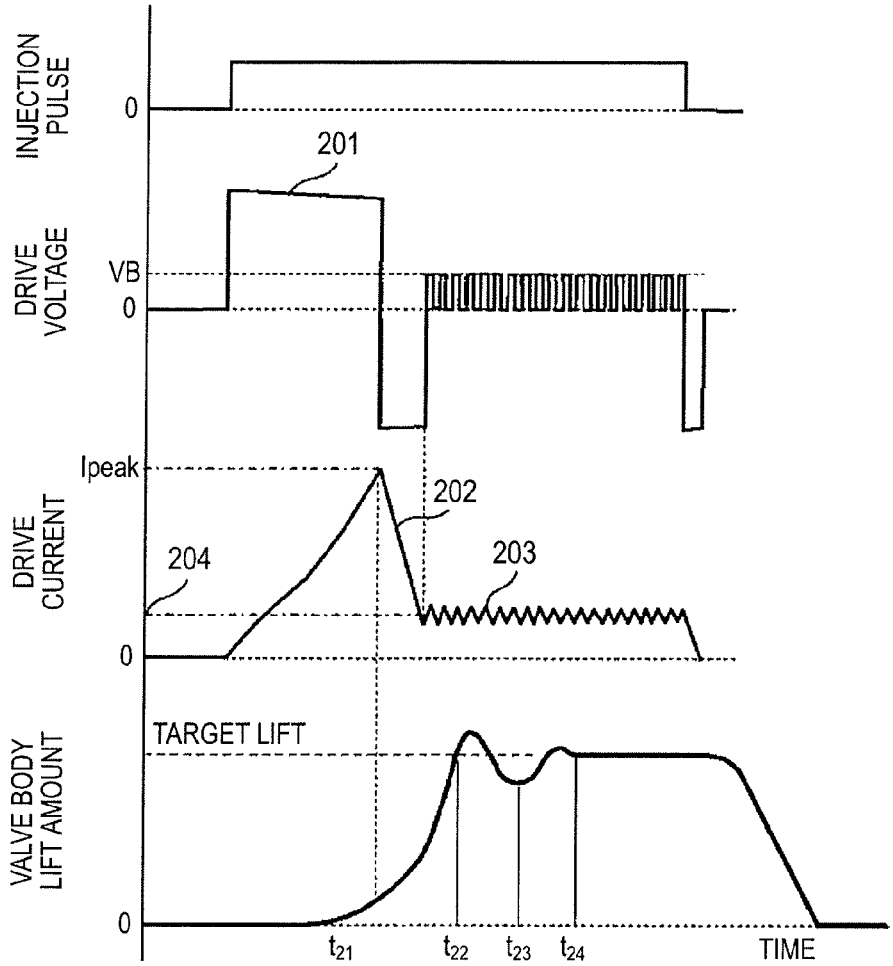
FIG. 2 is a diagram illustrating a relationship of an injection pulse output from an ECU, a voltage to be applied to the fuel injection device, a timing of an excitation current, and the amount of lift of a valve body according to the embodiment of the present invention.
Figure 3:
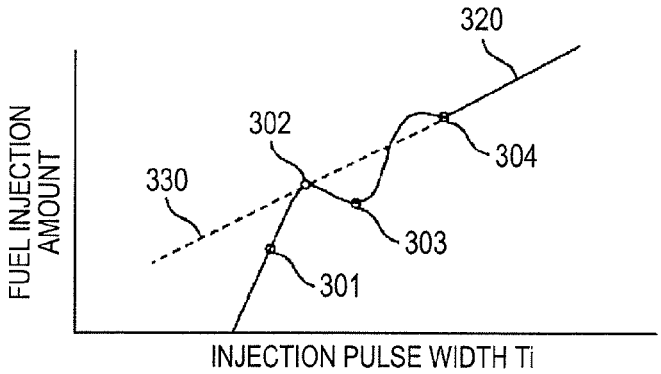
FIG. 3 is a diagram illustrating a relationship between a pulse width Ti of the injection pulse output from the ECU in FIG. 2, and the amount of fuel injection.

Subsequently, a description will be given of a relationship of a general injection pulse for driving the fuel injection device, a drive voltage, a drive current (excitation current), and a valve body displacement (valve body behavior) (FIG. 2), and a relationship between the injection pulse and the amount of fuel injection (FIG. 3).

When the injection pulse is input to the EDU 121, the EDU 121 applies a high voltage 201 to the solenoid 105 from a high voltage source boosted to a voltage higher than a battery voltage, and the supply of current to the solenoid 105 starts. When a current value reaches a predetermined peak current value $I_{peak}$ the EDU 121 stops the supply of the high voltage 201. Thereafter, the EDU 121 reduces a voltage to be applied to 0 V or lower, and decreases the current value as indicated by a current 202. When the current value becomes lower than a given current value 204, the EDU 121 switchingly applies the battery voltage to the solenoid 105, and controls the current value to a given current 203.

With the above-mentioned profile of the supply current, the fuel injection device is driven. During a period since the high voltage 201 is applied until the current reaches the peak current, the lift of the valve body 114 starts, and the valve body 114 finally reaches a target lift position. After arrival to the target lift position, the valve body 114 conducts bound operation due to a collision of the needle 102 with the magnetic core 107. Finally, the valve body 114 comes to rest at a given position (hereinafter referred to as "target lift position") due to the magnetic attractive force generated by a holding current of the given current 203, and comes to a stable valve open state. Because the valve body 114 can be relatively displaced relative to the needle 102, the valve body 114 is displaced beyond the target lift position.

Subsequently, a description will be given of the relationship between an injection pulse width Ti and the amount of fuel injection. FIG. 3 is a diagram illustrating a relationship between the injection pulse width output from the ECU, and the amount of fuel injection injected from the fuel injection device. If the injection pulse width is shorter than a given time, because the valve body 114 is not opened, no fuel is injected. Under the condition where the injection pulse width is short, for example, indicated by a point 301, the valve body 114 starts the lift. However, because a time during which the solenoid 105 is energized is short, the valve starts to be closed before the valve body 114 reaches the target lift position. As a result, the fuel is injected with a small amount of lift, and the amount of injection becomes smaller than that of a broken line 330 extrapolated from a linear area 320 having a linear relationship between the injection pulse width and the amount of fuel injection in an area where the injection pulse width is larger. In the pulse width at a point 302, the valve starts to be closed immediately after the valve body 114 has reached the target lift position, that is, immediately after the needle 102 and the magnetic core (fixed core) 107 contact with each other. In the pulse width at a point 303, the valve starts to be closed at a timing $t_{23}$ when the amount of bound of the valve body 114 becomes the maximum. Therefore, a time (hereinafter referred to as "close delay time") since the injection pulse is off until the valve body 114 contacts with the valve seat 118 becomes small, as a result of which the amount of injection is smaller than that of the broken line 330. In a state at a point 304, the valve starts to be closed at a timing $t_{24}$ immediately after the bound of the valve body 114 has been converged. In the injection pulse width larger than that at the point 304, the amount of fuel injection is linearly increased according to an increase in the injection pulse width. In an area where the injection pulse width is smaller than that at the point 304, the amount of lift of the valve body 114 is not stably held at the position of the target lift. Therefore, the amount of lift of the valve body 114 is liable to be unstable due to a change in the environmental condition such as the fuel pressure, thereby making it difficult to stabilize the amount of injection.

First Embodiment

Figure 4:
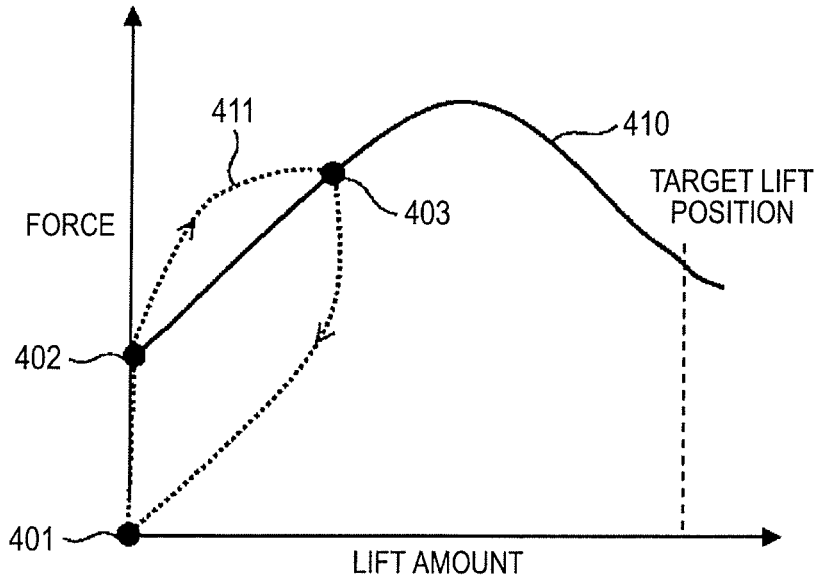
FIG. 4 is a diagram illustrating a relationship of the amount of lift of the valve body, a force exerted on the valve body in the valve closing direction, and a force exerted on a needle in the valve opening direction.

Subsequently, a configuration and operation of a first embodiment according to the present invention will be described with reference to FIG. 4 and FIG. 5. FIG. 4 is a diagram illustrating a relationship of the amount of lift of the valve body 114, a force exerted on the valve body 114 in the valve closing direction, and a force exerted on the needle 102 in the valve opening direction. A solid line 410 in the figure represents an absolute value of the force exerted on the valve body 114 in the valve closing direction, and a broken line 411 represents an absolute value of the force exerted on the needle 102 in the valve opening direction.

In a state point 401 where no current is supplied to the solenoid 105, the valve body 114 is urged in the valve closing direction by the load of the spring 110 and a force caused by the fuel pressure (hereinafter referred to as "hydrodynamic force"). When a current is supplied to the solenoid 105, an attractive force, which is a force in the valve opening direction, is generated between the needle 102 and the magnetic core 107. Then, the valve body 114 starts the lift in a state point 402 where the attractive force exceeds a force in the valve closing direction, which is represented by a sum of the load exerted on the valve body 114 by the spring 110 and the force caused by the hydrodynamic force. The load caused by the spring 110 is determined according to a spring constant of the spring 110 and the amount of push of the spring 110 from a natural length. Therefore, the amount of lift of the valve body 114 and the load caused by the spring 110 have a linear relationship. When the amount of lift of the valve body 114 is zero, the valve body 114 is urged in the valve closing direction due to a force of a product of the load caused by the spring 110, the fuel pressure, and a pressure receiving area (an area of a contact portion of the valve seat 118 and the valve body 114). When the valve body 114 is spaced away from the valve seat 118, and the amount of lift of the valve body 114 is small, a communication cross-sectional area between the valve body 114 and the valve seat 118 is small. As a result, a flow rate of the fuel flowing in the gap between the valve body 114 and the valve seat 118 is increased, and the hydrodynamic force exerted on the valve body 114 is increased by an increase in the pressure loss between the valve body 114 and the valve seat 118, and a reduction in a static pressure due to the Bernoulli's theorem. As the amount of lift of the valve body 114 is increased more, the communication cross-sectional area between the valve body 114 and the valve seat 118 is increased more. Therefore, the flow rate of the fuel flowing between, the valve body 114 and the valve seat 118 is decreased, and the hydrodynamic force exerted on the valve body 114 becomes small. For the above reasons, a size of the hydrodynamic force exerted on the valve body 114 is determined according to the amount of lift of the valve body 114, and a relationship between the amount of lift of the valve body 114 and the hydrodynamic force exerted on the valve body 114 has a range of a positive correlation until the valve body 114 reaches the target lift, and a range of a negative correlation when the amount of lift exceeds a given amount. In a range where a relationship between a sum of the hydrodynamic force exerted on the valve body 114 and the load caused by the spring 110, and the amount of lift of the valve body 114 has the positive correlation, the attractive force is controlled to a given size, and the hydrodynamic force is set to excel the magnetic attractive force according to the amount of lift of the valve body 114, thereby enabling the valve body 114 to start to be closed according to a given amount of lift. Thus, the valve body 114 starts to be closed in the range where the hydrodynamic force is increased according to an increase in the amount of lift of the valve body 114. As a result, the amount of lift of the valve body 114 can be accurately controlled in a state where the valve body 114 is in the intermediate lift between the valve closed state and the target lift position, not depending on a cancel timing of the current to be supplied to the solenoid 105, and the amount of injection can be accurately controlled. Also, in the state where the valve body 114 is in the intermediate lift, the size of the attractive force is controlled to control the amount of lift of the valve body 114 so that the amount of injection can be controlled. Also, in the fuel injection device for the gasoline internal combustion engine, the amount of injection is determined according to an integrated value of the amount of lift of the valve body 114, and the load caused by the spring 110 is adjusted so that the time since the injection pulse turns on until the valve body 114 reaches the target lift, and the time since the injection pulse turns OFF until the valve body 114 reaches the valve seat 118 are adjusted, and the flow rate may be adjusted so that an individual difference of the dynamic flow rate falls within a given range. In this fuel injection device, the load caused by the spring 110 is varied for each individual of the fuel injection devices, and even in a change in the condition such as the same fuel pressure, the valve opening timing since the current is supplied to the solenoid 105 until the valve body 114 is left from the valve seat 118 is varied. The hydrodynamic force exerted on the valve body 114 is used in a range of the amount of lift which becomes the positive correlation. The attractive force after the valve has been opened is controlled to a given value. As a result, the hydrodynamic force excels the attractive force with a given amount of lift regardless of the variation in the individual difference of the valve opening timing, and the valve closing timing of the valve body 114 is determined. This makes it possible to accurately control the amount of lift of the valve body 114, and to reduce the variation in the individual difference of the amount of injection.

Subsequently, as one of methods for conducting the operation illustrated in FIG. 4, a description will be given of a structure of the fuel injection device according to the first embodiment of the present invention with reference to FIGS. 1 and 5. FIG. 5 is an enlarged cross-sectional view illustrating a tip of the valve body 114 in the fuel injection device. In the valve closed state where the valve body 114 contacts with the valve seat 118, the valve body 114 is urged against the valve closing direction by a sum of the hydrodynamic force, which is a product of a seat diameter $d_s$ at a contact position of the valve body 114 and the valve seat 118, and the fuel pressure, and the load caused by the spring 110. When the valve body 114 is left from the valve seat 118 and starts the lift from the valve closed state, the fuel flows into a fuel passage 502 between the valve body 114 and the valve seat 118. The flow rate flowing in the fuel passage 502 is determined according to a cross-sectional area (hereinafter referred to as "fuel passage cross-sectional area $A_s$) of the fuel passage 502 when a gap between the valve body 114 and the valve seat 118 is minimum. The fuel passage cross-sectional area As can be derived from an angle of a seat surface 501, the amount of lift of the valve body 114, and the seat diameter ds, and a relationship thereof is represented by Expression (1).

$$As=std_s\pi sig(\theta/2) \quad (1)$$

where st is the amount of lift of the valve body 114, θ is the angle of the seat surface 501, and $d_s$ is the seat diameter.

The amount of lift of the valve body 114 is small, because the fuel passage cross-sectional area As is small, the flow rate of the fuel flowing in the vicinity of the seat diameter ds increases, and a pressure loss occurs in the fuel passage 502. In general, since the pressure loss increases in proportion to a dynamic pressure $(\rho v^2)/2$ (ρ is a density of fluid, and v is the flow rate), the pressure loss is more increased as the flow rate is larger. Also, when the flow rate is increased, a reduction in a static pressure due to the Bernoulli's theorem is increased with the result that the pressure in the vicinity of the seat diameter ds is decreased. The pressure on the tip of the valve body 114 is reduced due to the reduction in the static pressure in the vicinity of the seat diameter ds and the pressure loss. The hydrodynamic pressure exerted on the valve body 114 is a product of a differential pressure between a pressure upstream of the valve body 114 (for example, a contact position with the spring 110) and a pressure on the tip, and a pressure receiving area (for example, area of an outer diameter on the tip of the valve body). Therefore, as the pressure on the tip of the valve body 114 is lower, the hydrodynamic pressure exerted on the valve body 114 becomes larger. Also, when the amount of lift of the valve body 114 is small, the flow rate of the fuel flowing in the vicinity of the seat diameter ds becomes higher. Therefore, the pressure downstream of the seat diameter ds cannot be increased due to the reduction in the static pressure under the Bernoulli's theorem, the differential pressure between the upstream side of the valve body 114 and the tip becomes larger, and the hydrodynamic force exerted on the valve body 114 becomes larger. As the amount of lift is larger, the fuel passage cross-sectional area As between the valve body 114 and the valve seat 118 becomes larger, thereby decreasing the flow rate on the seat diameter ds. As the flow rate in the vicinity of the seat diameter ds is decreased, the reduction in the static pressure due to the Bernoulli's theorem is suppressed. Therefore, the pressures in the vicinity of the seat diameter ds and on the tip of the valve body 114 located downstream of the seat diameter ds are increased, the differential pressure between the upstream side of the valve body 114 and the tip thereof is reduced, and the hydrodynamic force exerted on the valve body 114 is decreased. A difference between the fuel injection device exerted on the valve body 114 when the valve is closed and the maximum value of the hydrodynamic force exerted on the valve body 114 after the valve has been opened is increased. As a result, a range in which a relationship between the hydrodynamic force exerted on the valve body 114 and the amount of lift of the valve body 114 becomes a positive correlation can be increased. The range of the amount of lift in which the valve body 114 is stabilized in the state of the intermediate lift between the valve closing position and the target lift position can be enlarged. Also, the shape of the tip of the valve body 114 may be configured so that the area of a tip outer diameter $d_p$ of the valve body 114 where the pressure is reduced when the valve body 114 is opened is larger than the area of the seat diameter ds in the valve closed state where the valve body 114 contacts with the valve seat 118. With this effect, the range where the static pressure is decreased due to the Bernoulli's theorem can be increased when the valve body 114 is opened. Therefore, the hydrodynamic force exerted on the valve body 114 when the valve is opened can be increased as compared with the hydrodynamic force exerted on the valve body 114 when the valve is closed. Also, the shape of the top of the valve body 114 may be configured by a spherical surface R. With this configuration, the range where the fuel passage between the valve body 114 and the valve seat 118 becomes a slight gap in the valve open state can be increased. Therefore, the area of the valve body 114 that receives the reduction in the pressure can be enlarged, and the hydrodynamic force exerted on the valve body 114 can be increased. With this advantage, the range of the amount of lift where the valve body 114 is stabilized in the state of the intermediate lift can be increased. When the spring constant of the spring 110 is set to be larger, the amount of compression of the spring 110 in the valve opening state where the needle 102 contacts with the magnetic core 107 is larger than that in the valve closing state where the valve body 114 contacts with the valve seat 118. Therefore, the load of the spring 110 becomes larger. This effect makes it possible to increase the range of the amount of lift in which the force exerted on the valve body 114 in the valve closing direction has a positive correlation with the amount of lift.

Figure 6:
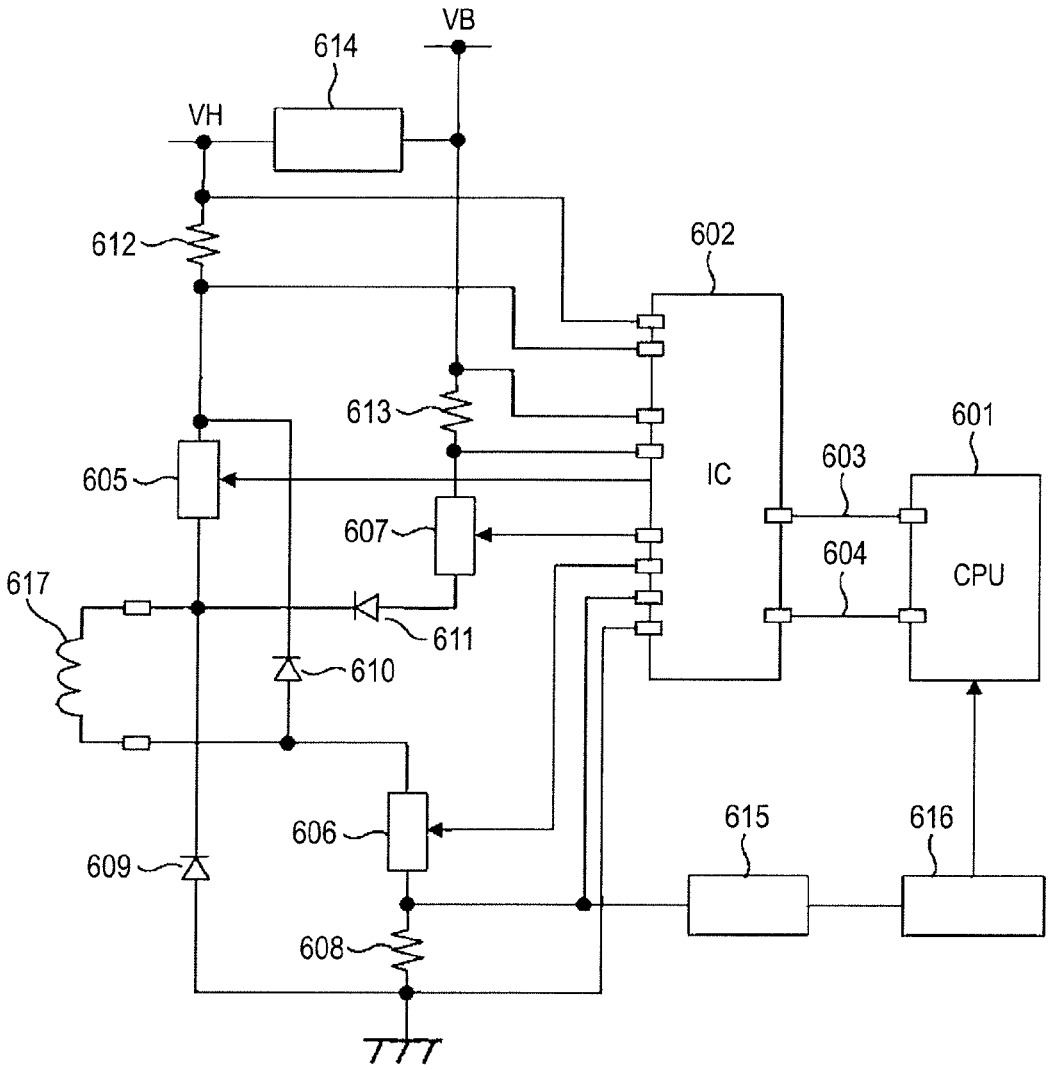
FIG. 6 is a configuration diagram illustrating a driver circuit for driving the fuel injection device according to the first embodiment of the present invention.

A description will be given of a driver circuit in the fuel injection device and a circuit configuration for controlling a given attractive force according the first embodiment of the present invention with reference to FIG. 6. FIG. 6 is a diagram illustrating the circuit configuration for driving a fuel injection device 617. A CPU 601 is, for example, included in an ECU, computes appropriate injection pulse width Ti and injection timing according to an operating condition of the internal combustion engine, and outputs the injection pulse Ti to a drive IC 602 of the fuel injection device through a communication line 604. Thereafter, the drive IC 602 switches on/off states of switching elements 605, 606, and 607 to supply a drive current to the fuel injection device 617.

The switching element 605 is connected between a high voltage source VH higher than a voltage source VB input to a driver circuit and a terminal of the fuel injection device 617 on a high voltage side. The switching element is configured by, for example, an FET or a transistor. The high voltage source VH is, for example, 60V, and generated by boosting a battery voltage through a booster circuit 614. The booster circuit is configured by, for example, a DC/DC converter. The fuel injection device 607 is connected between the low voltage source VB and a high voltage terminal of the fuel injection device. The low voltage source VB is, for example, a battery voltage, and 12V. The switching element 606 is connected between a terminal of the fuel injection device on a low voltage side and a ground potential. The drive IC 602 detects a current value flowing in the fuel injection device 607 by the aid of current detection resistors 608, 612, and 613, and switches the on/off states of the switching elements 605, 606, and 607 by a detected current value to generate a desired one drive current. Diodes 609 and 610 are provided to block the current. The CPU 601 communicates with the drive IC 602 through a communication line 603, and can switch the drive current generated by the drive IC 602 according to the pressure of the fuel to be fed to the fuel injection device and the operating condition. The current detection resistor 608 is connected with the CPU 601 through a comparator 616 connected with a differentiator 615. A voltage between both ends of the solenoid 105 is a sum of a voltage drop that is a product of a resistance and a current value of the solenoid 105 under the Ohm's law, and a back electromotive force caused by self-induction which is a product of an inductance of the solenoid 105 and a temporal differentiation of a current flowing in the solenoid 105. When the current is supplied to the solenoid 105, the back electromotive force is developed in the solenoid 105. As the back electromotive voltage is larger, the voltage drop is smaller under the Ohm's law. Therefore, even if the current is supplied to the solenoid 105 from a constant voltage source, a relationship between a supply time of the current and the current flowing in the solenoid 105 is not linear, and becomes a first order lag. Also, when the current is supplied to the solenoid 105 from the constant voltage source, a magnetic flux developed in the magnetic circuit, which is a product of the current flowing in the solenoid 105 and the inductance thereof is increased with time elapse. The valve body 114 is left from the valve seat 118, and starts the lift at a timing when the attractive force exerted on the needle 102 exceeds the force exerted on the valve body 114 in the valve closing direction. When the valve body 114 starts the lift, the gap between the needle 102 and the magnetic core 107 becomes smaller, and a magnetic resistance of the magnetic circuit becomes smaller. Therefore, the magnetic flux that can be generated between the needle 102 and the magnetic core 107 is increased. Because the temporal differential value of the current is inversely proportional to the magnetic flux, if the magnetic gap is reduced, and the magnetic flux is precipitously increased, the temporal differential value of the current is precipitously decreased. Regarding the timing when the temporal differentiation of the current is precipitously reduced, for example, the timing when the voltage becomes lower than a threshold value set by the comparator 616 in advance can be detected by the CPU 601 through the differentiator 615 connected to the current detection resistor 608. Also, two differentiators are connected in series with the current detection resistor 608, and a change in the inductance accompanied by an increase in the magnetic flux can be detected by the CPU 601 as a change in a slope of the current differential value. Through the above method, the valve opening timing when the valve body 114 is left from the valve seat 118, and starts the lift can be detected by the CPU 601. The current supply to the solenoid 105 stops a given time after the valve opening timing detected by the CPU 601 so that the given attractive force can be controlled. With the above configuration, even if the valve opening timing is varied for each individual of the fuel injection devices, the attractive force can be controlled, and the amount of lift can be accurately controlled when the valve body 114 is in the state of the intermediate lift. If the current value to be supplied to the solenoid 105 is kept constant, the attractive force changes depending on a height of the gap (hereinafter referred to as "magnetic gap") between the needle 102 and the magnetic core 107. If the magnetic gap is larger, the magnetic resistance between the needle 102 and the magnetic core 107 becomes larger, the number of magnetic flux that can pass through the attractive surface is reduced, and the attractive force becomes small. Also, when the valve body 114 is opened to reduce the magnetic gap, an eddy current operates to cancel the magnetic flux within the magnetic circuit. Therefore, the attractive force is changed after the constant delay time. Accordingly, the amount of lift of the valve body 114 can be indirectly estimated by detecting the valve opening timing, and the timing (hereinafter referred to as "target lift arrival timing") when the needle 102 and the magnetic core 107 collide with each other. As a result, because the attractive force can be controlled taking the change in the magnetic flux accompanied by the change in the magnetic gap into account, a precision in the amount of lift when the valve starts to be closed in the state of the intermediate lift can be improved. Also, when the change in the attractive force due to the current to be supplied to the solenoid 105 is precipitous, the change in the amount of lift since the valve body 114 starts the lift is also precipitous. As a result, it is difficult to control the timing when the supply of the current stops, and therefore it is preferable that the supply of current to the solenoid 105 is conducted by the battery power supply, or a voltage source smaller than the high voltage source VH. Also, it is preferable that a low-pass filter for noise removal may be arranged between the differentiator 615 and the comparator 616. Noise that is a high-frequency component is removed by a low-pass filter so that the valve opening timing of the valve body 114 can be stably detected by the CPU 601. The current detection resistor 608, the differentiator 615, and the comparator 616 may be included within the drive IC 602 from the viewpoint of the circuit configuration. In this case, a signal from the differentiator 615 may be input to not the CPU 601 but the drive IC 602. In the above configuration, the timing when the current supply to the solenoid 105 stops after the valve has been opened can be controlled by directly driving the switching elements 605, 606, and 607 by the drive IC 602 with a signal from the differentiator 615 as an input trigger.

Second Embodiment

Figure 7:
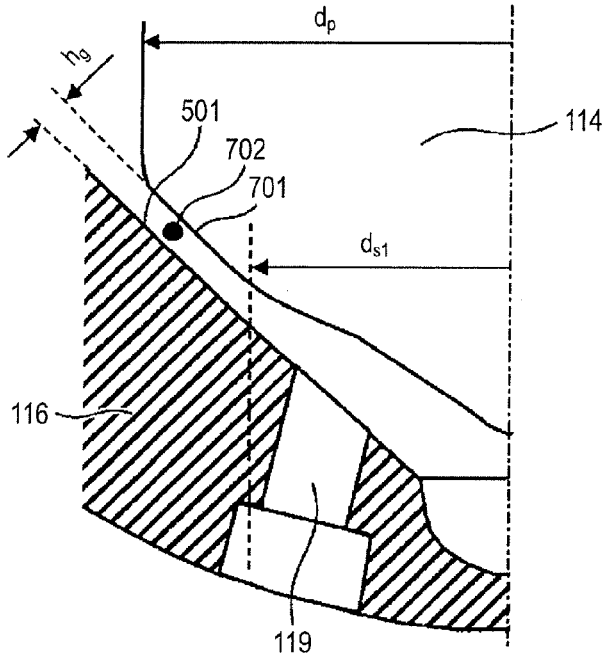
FIG. 7 is an enlarged cross-sectional view illustrating a valve body tip in a fuel injection device according to a second embodiment of the present invention.

A second embodiment according to the present invention will be described with reference to FIG. 7. FIG. 7 is an enlarged cross-sectional view illustrating a valve body tip in a fuel injection device according to the second embodiment of the present invention. In FIG. 7, the same constituent components as those in FIGS. 1 and 5 are denoted by identical numerals or symbols.

In an example illustrated in FIG. 7, in the configuration of the first embodiment, a seat diameter $d_{s1}$ of the valve body 114 is reduced, and a tapered surface 701 is provided upstream of the seat diameter ds1. The hydrodynamic force exerted on the valve body 114 when the valve is closed is a product of the area of the seat diameter $d_{s1}$ and the fuel pressure. Therefore, the seat diameter $d_{s1}$ is reduced so that the force exerted on the valve body 114 in the valve closing direction can be reduced when the valve is closed. Also, when a taper 701 is formed upstream of the seat diameter $d_{s1}$, as compared with a case in which a portion upstream of the seat diameter $d_{s1}$ of the valve body 114 is configured by the spherical surface R equivalent to the seat diameter $d_{s1}$ portion, a gap $H_g$ of a fuel passage 702 between the seat surface 501 of the valve seat 118 and the tip of the valve body 114 can be reduced. The area of the range where the static pressure is reduced under the Bernoulli's theorem after the valve body 114 has been opened can be increased. Therefore, the hydrodynamic force exerted on the valve body 114 can be increased. It is preferable that an angle of the taper 701 may be equivalent to an angle of the seat surface 501 of the valve seat 118. As a result, because the gap between the valve body 114 and the valve seat 118 can be accurately determined, a variation in the individual difference of the hydrodynamic force exerted on the valve body 114 after the valve has been opened is reduced, and easily managed. With the above advantages, a difference between the hydrodynamic force exerted on the valve body 114 when the valve is closed and the maximum value of the hydrodynamic force exerted on the valve body after the valve has been opened can be increased. The range of the amount of lift where the amount of lift and the hydrodynamic force of the valve body 114 have a positive correlation can be increased. As a result, the range of the amount of lift where the valve body 114 is stabilized in the state of the intermediate lift between the valve closing position and the target lift position is increased, and the range of the controllable amount of injection is improved.

Third Embodiment

Figure 8:
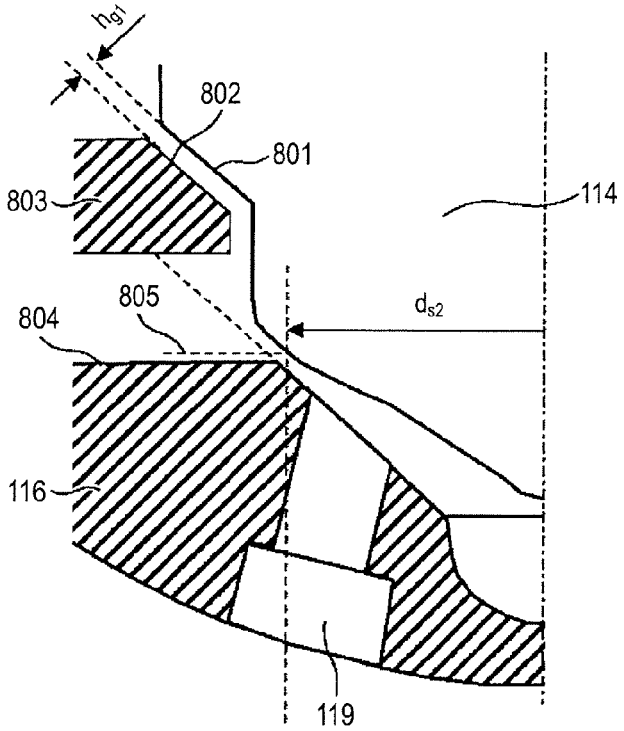
FIG. 8 is an enlarged cross-sectional view illustrating a valve body tip in a fuel injection device according to a third embodiment of the present invention.

A third embodiment according to the present invention will be described with reference to FIGS. 1 and 8. FIG. 8 is an enlarged cross-sectional view illustrating a valve body tip in a fuel injection device according to the third embodiment of the present invention. Referring to FIG. 8, the same constituent components as those in FIGS. 1 and 5 are denoted by identical numerals or symbols.

In an example illustrated in FIG. 8, in the configuration of the first embodiment, a seat diameter $d_{s2}$ of the valve body 114 is reduced, a taper 801 is provided upstream of the seat diameter $d_{s2}$, and an inclined portion 803 is provided on an orifice cup 116. With the above configuration, a slight gap $h_{g1}$ can be defined between the taper 801 and the inclined portion 803. In addition to the vicinity of the seat diameter $d_{s1}$ of the valve body 114, the range where the static pressure is reduced by the Bernoulli's theorem can be provided in the taper 801. The same effects as those described above can be obtained even if the inclined portion 803 is integrated with not the orifice cup 116 but a PR guide 115.

Also, it is preferable that a planar portion 804 is disposed in the orifice cup 116 so that when the valve body 114 is located at the target lift, a position of the seat diameter $d_{s2}$ in the height direction when the valve is closed is located upstream of the planar portion 804. In general, a flow rate (hereinafter referred to as "static flow") per unit time, which is injected from the fuel injection device is determined according to the fuel passage cross-sectional area of the valve body 114 and a total cross-sectional area of nozzles 119 when the fuel pressure is kept constant. When the seat diameter is reduced, the fuel passage cross-sectional area is reduced, and therefore the static flow rate at the target lift position is reduced. The position of the seat diameter ds in the height direction is upstream of the inclined portion 803 at the target lift position. Therefore, because the minimum gap between the valve body 114 and the orifice cup 116 does not depend on the seat diameter ds2 at the position of the target lift, the static flow when the valve body 114 is located at the target lift position can be increased while keeping the small seat diameter ds2. Accordingly, because the static flow can be increased while the large hydrodynamic force necessary to stabilize the valve body 114 in the state of the intermediate lift is kept, the fuel injection device can be easily designed. Also, the value of the static flow in the state of the intermediate lift can be reduced as compared with the value of the static flow when the valve body 114 is located at the position of the target lift. Therefore, the flow rate when the valve body 114 is in the state of the intermediate lift can be reduced.

Fourth Embodiment

Figure 9:
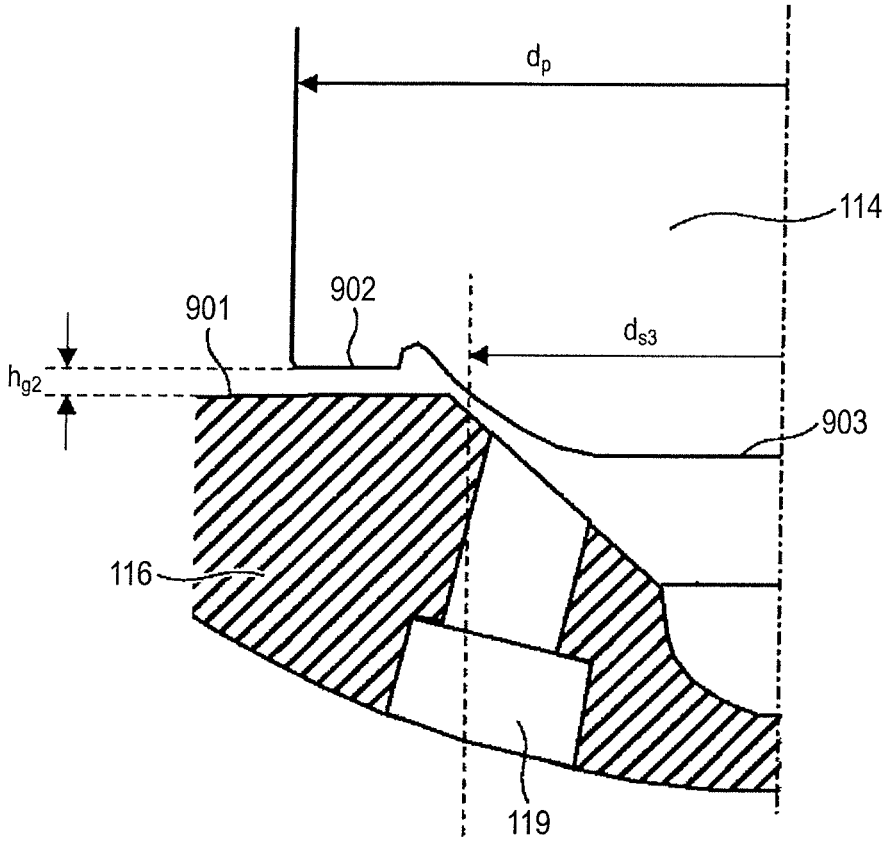
FIG. 9 is an enlarged cross-sectional view illustrating a valve body tip in a fuel injection device according to a fourth embodiment of the present invention.

A fourth embodiment according to the present invention will be described with reference to FIGS. 1 and 9. FIG. 9 is an enlarged cross-sectional view illustrating a tip of the valve body 114 in a fuel injection device according to the fourth embodiment of the present invention. Referring to FIG. 9, the same constituent components as those in FIGS. 1 and 5 are denoted by identical numerals or symbols.

In an example illustrated in FIG. 9, in the configuration of the first embodiment, a seat diameter $d_{s3}$ at which the valve body 114 contacts with the valve seat 118 is reduced, a planar portion 902 is provided upstream of the seat diameter ds3 of the valve body 114, and a planar portion 901 is disposed on the orifice cup 116.

With the above configuration, the slight gap hg2 can be defined between the planar portion 901 of the orifice cup 116 and the planar portion 902 of the valve body 114. In addition to the vicinity of the seat diameter $d_{s3}$ of the valve body 114, the range where the static pressure is reduced by the Bernoulli's theorem can be provided in the planar portion 902. Therefore, the hydrodynamic force exerted on the valve body 114 becomes large, and the range in which the hydrodynamic force and the amount of lift have a positive correlation can be increased. Also, a diameter of the outer diameter dp of the planar portion 902 is changed so that the range (hereinafter referred to as "pressure receiving portion") where the static pressure is reduced due to the Bernoulli's theorem can be changed. Therefore, the hydrodynamic force exerted on the valve body 114 can be designed with the area of the pressure receiving portion, and the fuel injection device can be easily designed.

Fifth Embodiment

Figure 5:
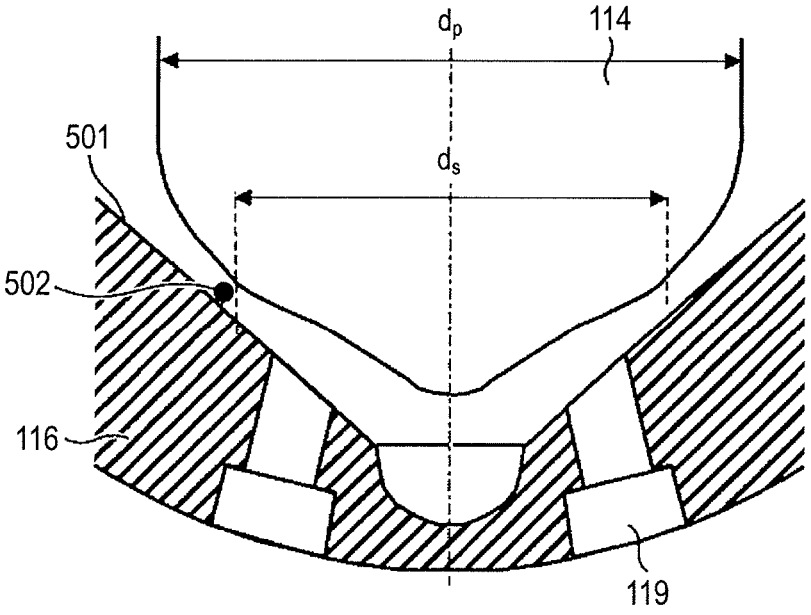
FIG. 5 is an enlarged cross-sectional view illustrating a valve body tip in a fuel injection device according to a first embodiment of the present invention.
Figure 10:
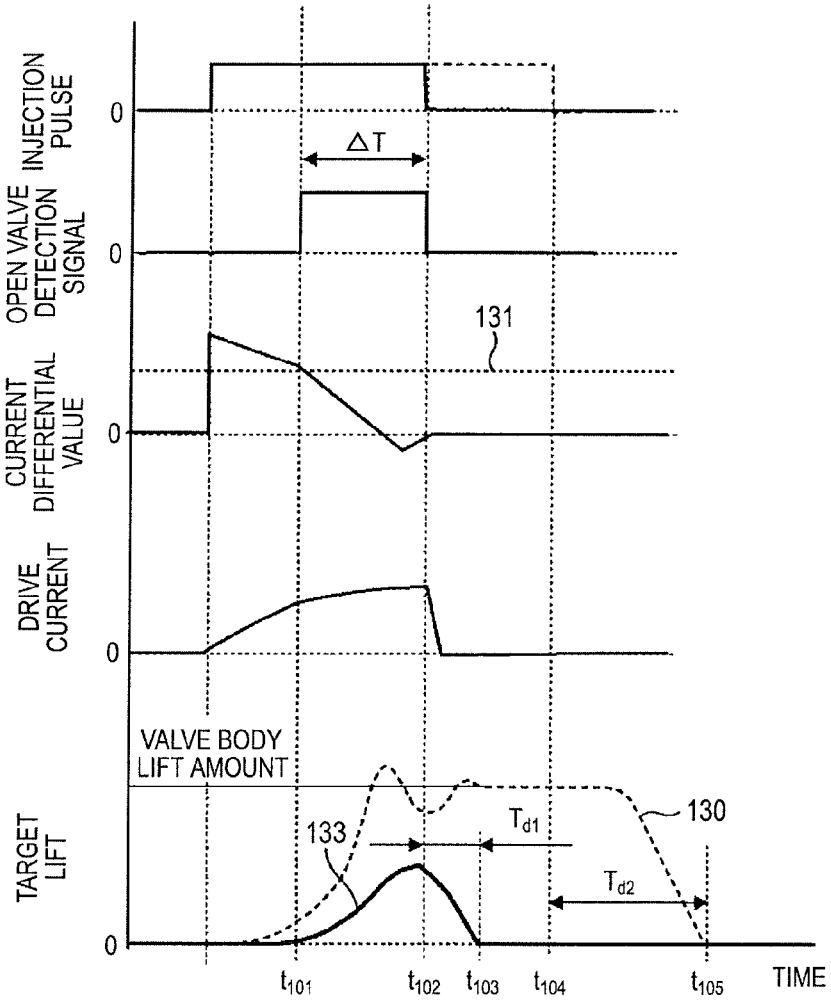
FIG. 10 is a diagram illustrating a relationship of an injection pulse width output from an ECU, an open valve detection signal output from a comparator, a differential value of an excitation current, a timing of the excitation current, and the amount of lift of the valve body according to a fifth embodiment of the present invention.

In a fifth embodiment, a seat portion of the valve body 114 in the fuel injection device illustrated in FIG. 1 is configured as illustrated in FIG. 5, and a control method for driving the fuel injection device by using the driver circuit illustrated in FIG. 6 is conducted as illustrated in FIG. 10.

FIG. 10 is a diagram illustrating a relationship of an injection pulse width output from an ECU (engine control unit), a detection signal of the valve opening timing (hereinafter referred to as "open valve detection signal") output from the comparator 616, a differential value of a drive current, a timing of the drive current, and the amount of lift of the valve body 114 according to the fifth embodiment of the present invention. In FIG. 10, the behavior of the valve body 114 in the intermediate lift state where the valve body 114 is so controlled as not to reach the target lift is indicated by a solid line 133, the behavior of the injection pulse and the valve body 114 when the valve body 114 is so controlled as to reach the target lift is indicated by a broken line 130.

When the injection pulse is entered, a voltage is applied from the battery voltage VB, and the supply of a current to the solenoid 105 starts. When the valve body 114 starts the lift, a gap between the needle 102 and the magnetic core 107 becomes smaller, and a magnetic resistance within the magnetic circuit is reduced. As a result, a magnetic flux that can be generated between the needle 102 and the magnetic core 107 is increased. Because the temporal differential value of the current is inversely proportional to the magnetic flux, if the magnetic gap is reduced, and the magnetic flux is precipitously increased, the temporal differential value of the current is precipitously decreased. The open valve detection signal turns on at a timing $t_{101}$ when the current exceeds a threshold value 131 of the comparator 616 given with a reference voltage corresponding to the temporal differential value. The open valve detection signal represents that the magnetic attractive force reaches a given value by the energization to the solenoid 105. A time ΔT from the timing $T_{101}$ is calculated by the aid of a timer or a counter. After the time ΔT has elapsed, the injection pulse turns off so that the magnetic attractive force exerted on the needle 102 can be stably controlled. If the magnetic attractive force is thus controlled to a given value, the hydrodynamic force exerted on the valve body 114 excels the magnetic attractive force when the valve body 114 reaches a given amount of lift, and the valve starts to be closed. The size of the magnetic attractive force is controlled so that the amount of lift at a valve close start point 403 in FIG. 4 can be accurately controlled. With the accurate control of the amount of lift, the amount of injection can be also accurately controlled. Because the amount of lift of the valve body 114 at that time is in the so-called intermediate lift state, the amount of lift is small, and therefore a slight amount of injection is obtained, as compared with a case where the valve body 114 reaches the target lift. Also, when the open valve detection signal is input directly to not the CPU 601 but the drive IC 602, the time ΔT can be controlled by the drive IC 602 by providing the drive IC 602 with a timer function. Even in this case, the advantages of the present invention are not changed.

When the above control is conducted, a time (hereinafter referred to as "close delay time") since the injection pulse turns off until the valve body 114 contacts with the valve seat 118 is determined depending on the amount of lift of the valve body 114 when the valve starts to be closed if the environmental conditions such as the structure of the fuel injection device and the fuel pressure are identical. A relationship between a moving distance of the valve body 114 and the time is determined according to a temporal integrated value of the force such as the magnetic attractive force and the hydrodynamic force which are exerted on the valve body 114 and the needle 102, and the load caused by the spring. Therefore, when the operating force is identical, a time required to open the valve is more increased as the amount of lift is larger. Accordingly, as compared with a close delay time $T_{d2}$ of a valve behavior 130 when the valve body 114 is controlled to reach the target lift, a close delay time Td1 of a valve behavior 133 in the intermediate lift state where the valve starts to be closed at the intermediate lift position can be shortened. Also, when the valve body 114 starts to be closed from the state of the intermediate lift, as compared with a case in which the valve starts to be closed from the target lift position, the gap between the needle 102 and the magnetic core 107 is increased at the timing when the valve starts to be closed. For that reason, a magnetic flux that can be generated in the magnetic circuit is reduced, and the magnetic attractive force is small. The attractive force at the timing when the valve starts to be closed is affected by a time since the current supply to the solenoid 105 stops until the magnetic flux in the magnetic circuit disappears to decrease the magnetic attractive force. Accordingly, in the state of the intermediate lift in which the attractive force is small at the timing when the valve starts to be closed, the close delay time can be shortened. Because the amount of injection depends on the temporal integrated value of the amount of lift of the valve body 114, the controllable amount of injection can be reduced with a reduction in the close delay time.

Also, in the fuel injection device in which the needle 102 and the valve body 114 are of different structures as illustrated in FIG. 1, when the valve body 114 collides with the valve seat 118 when the valve is closed, the needle 102 is left from the valve body 114 to continue the motion. A time during which the needle 102 continues the motion depends on a motion energy of the needle 102 when the valve body 114 collides with the valve seat 118. The motion energy is determined according to the masses of the needle 102 and the valve body 114 and a velocity (hereinafter referred to as "collision velocity") when the valve body 114 collides with the valve seat 118. As the amount of lift of the valve body 114 becomes larger, because a time when the needle 102 can be accelerated until the valve body 114 and the needle 102 close the valve is increased, the collision velocity is also increased. Also, the motion energy of the needle 102 when the valve body 114 collides with the valve seat 118 is increased. Accordingly, as compared with a case in which the valve starts to be closed in the target lift, when the valve starts to be closed from the state of the intermediate lift, the motion energy when the valve body 114 collides with the valve seat 118 can be reduced. For that reason, a time when the needle 102 comes to rest after the valve has been closed can be reduced. If subsequent injection is conducted while the needle 102 continues the motion after the valve body 114 has been closed, it may be difficult to stabilize the amount of injection during reinjection. Therefore, a time until the needle 102 comes to rest is shortened so that an interval at which a subsequent injection is conducted after a first injection has been completed during one stroke can be shortened, and the number of injections that are enabled during one stroke can be increased. Also, in the intermediate lift, because the valve closing speed of the valve body 114 is reduced, there is obtained an advantage of reducing a drive sound generated when the valve body 114 collides with the valve seat 118.

For example, when the engine is idling, an operating sound of the fuel injection device is likely to be relatively loudly heard, and the amount of injection as required is also small. Accordingly, if a drive for starting to close the valve is used in the intermediate lift, the noise is liable to be reduced. Also, the collision speed of the valve body 114 and the valve seat 118 is so reduced as to obtain the effect of reducing abrasion of the valve seat 118 and the valve body 114. For example, the above configuration is easily used under the high fuel pressure.

Sixth Embodiment

Figure 11:
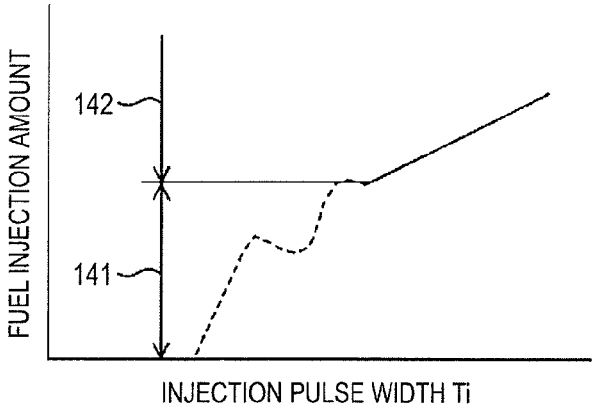
FIG. 11 is a diagram illustrating a relationship between an injection pulse width output from an ECU and the amount of fuel injection according to a sixth embodiment of the present invention.

A sixth embodiment according to the present invention will be described with reference to FIGS. 1 and 11. FIG. 11 is a diagram illustrating a relationship between an injection pulse width output from an ECU (engine control unit) and the amount of fuel injection according to the sixth embodiment of the present invention.

A relationship between the injection pulse width and the amount of fuel injection has a nonlinear area (hereinafter referred to as "nonlinear area") 141 when the injection pulse width is small, and a linear area (hereinafter referred to as "linear area") 142 when the injection pulse width is large. In the linear area 142, a desired amount of fuel injection can be obtained by changing the injection pulse width. In the nonlinear area 141, because a relationship between the injection pulse width and the amount of fuel injection is not linear, the amount of fuel injection cannot be controlled according to the injection pulse width. In order to control the amount of fuel injection in the nonlinear area 141, driving for starting to close the valve in the intermediate lift is used.

In the drive using the intermediate lift for controlling the amount of fuel injection in the nonlinear area 141, the magnetic attractive force is controlled to a given value, as a result of which the hydrodynamic force exerted on the valve body 114 when the valve body 114 reaches a given amount of lift excels the magnetic attractive force to start to close the valve. The size of the magnetic attractive force is controlled to accurately control the amount of lift at the valve close start timing, and the amount of fuel injection is proportional to a ½ power of the fuel pressure. Therefore, the pressure of the fuel to be fed to the fuel injection device is increased or decreased so as to control the amount of fuel injection. Also, the number of injections during one stroke is changed by driving using the intermediate lift so as to control a desired amount of fuel injection. The amount of lift of the valve body 114, the fuel pressure, and the number of injections are so adjusted as to obtain a desired amount of fuel injection.

What is claimed is:

1. A fuel injection device, comprising:

a valve body that contacts with a valve seat to close a fuel passage, and moves away from the valve seat to open the fuel passage;

a needle that executes valve opening/closing operation in cooperation with the valve body;

an electromagnet that includes a coil and a magnetic core provided as a driver for driving the needle, and a cylindrical nozzle holder disposed on an outer periphery of the magnetic core and the needle; and an urging unit that urges the valve body in a direction opposite to a direction of a driving force by the driver, in which a current is supplied to the coil to exert a magnetic attractive force between the magnetic core and the needle to open the valve body, wherein the valve body starts the valve closing operation at an intermediate position between a valve closing position where the valve body contacts with the valve seat and a maximum amount of lift of the valve body, and a hydrodynamic force exerted on the valve body and the needle in a valve closing direction is increased up to at least a lift position where the valve closing operation starts.

2. A driver circuit for driving the fuel injection device according to claim 1, wherein in a change in an inductance caused by a change in a back electromotive voltage developed when the coil is energized, a temporal differential value of a current flowing in the coil is detected to detect a timing at which the valve body is left from the valve seat, and the detected timing is fed back to one of an arithmetic device and a timer in the driver circuit to control the magnetic attractive force.

3. A method for driving a fuel injection device, comprising:

contacting a valve body with a valve seat to close a fuel passage;

moving the valve body away from the valve seat to open the fuel passage;

executing valve opening/closing operation using a needle in cooperation with the valve body;

driving the needle using an electromagnet that includes a coil and a magnetic core, providing a cylindrical nozzle holder on an outer periphery of the magnetic core and the needle; and urging, with an urging unit, the valve body in a direction opposite to a direction of a driving force by the driver, in which a current is supplied to the coil to exert a magnetic attractive force between the magnetic core and the needle to open the valve body, wherein the valve body starts the valve closing operation at an intermediate position between a valve closing position where the valve body contacts with the valve seat and a maximum amount of lift of the valve body, and a hydrodynamic force exerted on the valve body and the needle in a valve closing direction is increased up to at least a lift position where the valve closing operation starts.

4. The method according to claim 3, wherein a driver circuit that supplies a current to the fuel injection device includes a booster circuit that is connected to a power supply, and boosts a supply voltage to a voltage higher than the supply voltage so as to provide a higher voltage source and a lower voltage source, and supplies a current to the fuel injection device from the lower voltage source when allowing the valve body to start the valve closing operation at the intermediate position.

5. The method according to claim 4, wherein the voltage source can be switched between the higher voltage source and the lower voltage source provided in the driver circuit when the valve body is opened from a state where the valve body contacts with the valve seat.

6. The method according to claim 3, wherein in a change in an inductance caused by a change in a back electromotive voltage developed when the coil is energized, a temporal differential value of a current flowing in the coil is detected to detect a timing at which the valve body is left from the valve seat, and the detected timing is fed back to one of an arithmetic device and a timer in the driver circuit to control the magnetic attractive force.

7. The method according to claim 6, wherein a driver circuit that supplies a current to the fuel injection device includes a booster circuit that is connected to a power supply, and boosts a supply voltage to a voltage higher than the supply voltage so as to provide a higher voltage source and a lower voltage source, and supplies a current to the fuel injection device from the lower voltage source when allowing the valve body to start the valve closing operation at the intermediate position.

* * * * *